US006843189B2

(12) United States Patent
Chang

(10) Patent No.: US 6,843,189 B2
(45) Date of Patent: Jan. 18, 2005

(54) SEWING MACHINE HAVING A THREAD TENSION ADJUSTING DEVICE

(76) Inventor: Tseng Hsien Chang, No. 206-7, Sec. 1, Guoguang Rd., Dali City, Taichung (TW), 412

( * ) Notice: Subject to any disclaimer, the term of this patent is extended or adjusted under 35 U.S.C. 154(b) by 16 days.

(21) Appl. No.: 10/443,759

(22) Filed: May 23, 2003

(65) Prior Publication Data

US 2004/0231576 A1 Nov. 25, 2004

(51) Int. Cl.[7] ..... D05B 47/00
(52) U.S. Cl. ..... 112/254
(58) Field of Search ..... 112/254, 302, 112/255, 223; 242/147 R, 149, 150 R, 153, 154, 156, 156.2

(56) References Cited

U.S. PATENT DOCUMENTS 3,500,781 A * 3/1970 Peschke ..... 112/254
4,356,781 A * 11/1982 Rodda ..... 112/184
4,520,743 A * 6/1985 Zylbert ..... 112/255
6,050,205 A * 4/2000 Terao ..... 112/254
6,089,172 A * 7/2000 Takenoya et al. ..... 112/470.04

* cited by examiner

*Primary Examiner*—Ismael Izaguirre
(74) *Attorney, Agent, or Firm*—Rosenberg, Klein & Lee

(57) ABSTRACT

A sewing machine includes a thread tension adjusting device, and a thread tension releasing device. The thread tension adjusting device includes a thread press member formed with a release extension portion. The thread tension releasing device presses the release extension portion of the thread press member to pivot the thread press member so as to move the thread clamping portion of the thread press member. Thus, the thread tension releasing device directly presses the release extension portion of the thread press member, so as to release the tension of the sewing thread, so that the tension of the sewing thread can be released easily and rapidly.

10 Claims, 6 Drawing Sheets

SEWING MACHINE HAVING A THREAD TENSION ADJUSTING DEVICE

BACKGROUND OF THE INVENTION

1. Field of the Invention

The present invention relates to a sewing machine, and more particularly to a sewing machine, wherein the thread tension releasing device directly presses the thread tension adjusting device so as to release the tension of the sewing thread, so that the tension of the sewing thread can be released easily and rapidly.

2. Description of the Related Art

A conventional sewing machine comprises a thread tension adjusting device, and a thread tension releasing device. When the sewing thread passes through the thread tension adjusting device, the sewing thread is stretched by the thread tension adjusting device, so that the sewing thread has a determined tension. In addition, the thread tension releasing device includes a movable plate extended into the thread tension adjusting device to detach the sewing thread from the thread tension adjusting device, so that the tension of the sewing thread can be released, thereby facilitating the later thread drawing and cutting procedures after the sewing work is accomplished.

SUMMARY OF THE INVENTION

The primary objective of the present invention is to provide a sewing machine, wherein the thread tension releasing device directly presses the release extension portion of the thread press member of the thread tension adjusting device, so as to release the tension of the sewing thread, so that the tension of the sewing thread can be released easily and rapidly.

Another objective of the present invention is to provide a sewing machine, wherein the tension of the sewing thread is released by operating the lift control member directly, so that the tension of the sewing thread can be released exactly and rapidly, thereby simplifying the tension release operation.

A further objective of the present invention is to provide a sewing machine, wherein the thread press member is integrally formed with the release extension portion without having to additionally provide other element, thereby simplifying the construction, and thereby saving costs of fabrication.

In accordance with the present invention, there is provided a sewing machine, comprising:

a thread tension adjusting device including a thread press member having a first end and a second end, the second end of the thread press member being formed with a release extension portion; and a thread tension releasing device rested and pressed on the release extension portion of the second end of the thread press member of the thread tension adjusting device to pivot the thread press member so as to move the first end of the thread press member.

Further benefits and advantages of the present invention will become apparent after a careful reading of the detailed description with appropriate reference to the accompanying drawings.

DETAILED DESCRIPTION OF THE INVENTION

Figure 1:
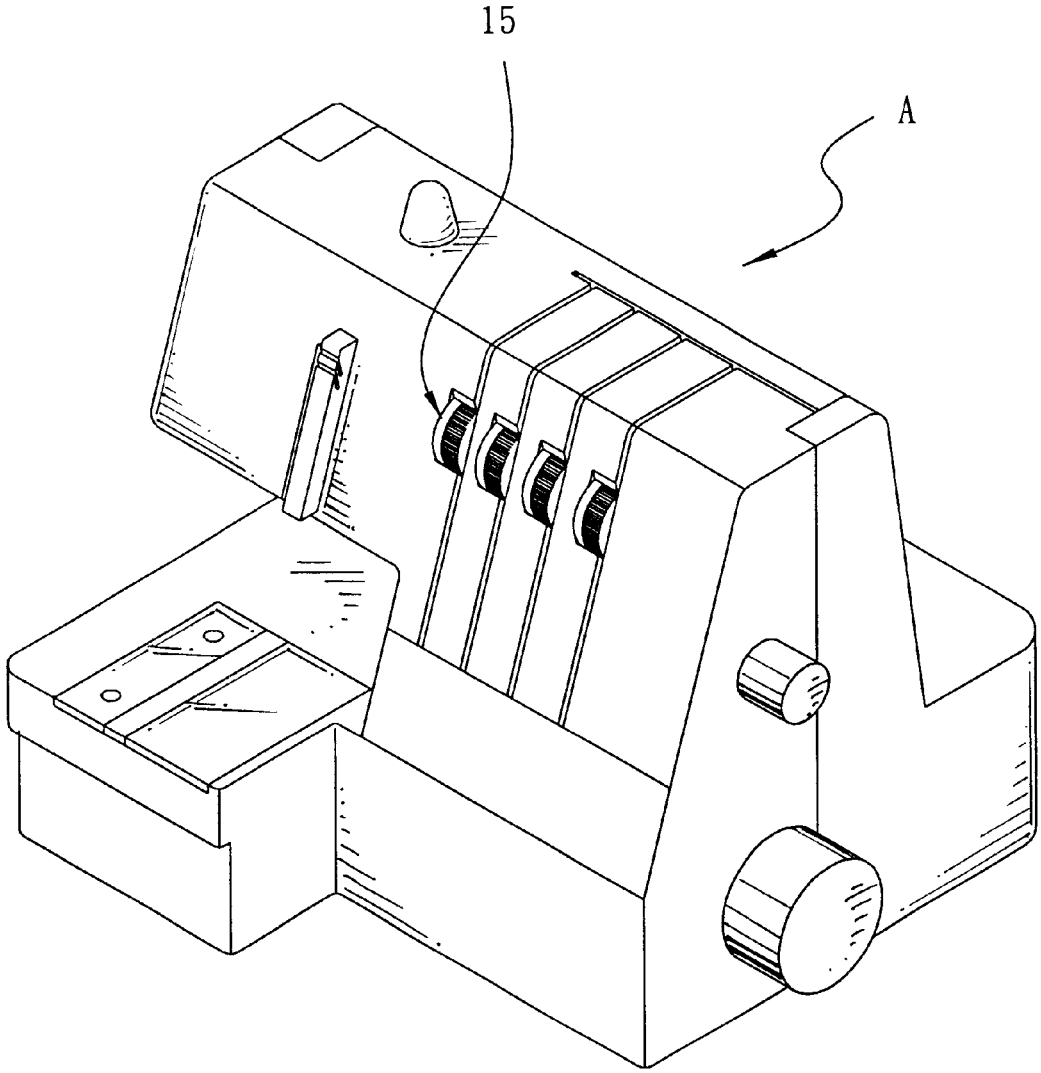
FIG. 1 is a perspective view of a sewing machine in accordance with the preferred embodiment of the present invention.

Referring to the drawings and initially to FIGS. 1–4, a sewing machine "A" in accordance with the preferred embodiment of the present invention comprises a thread tension adjusting device "B", and a thread tension releasing device "C".

The thread tension adjusting device "B" includes a support seat 10 fixed on the sewing machine "A". The support seat 10 has an end portion provided with a horizontally arranged wheel shaft 100 and a horizontally arranged limit shaft 101. The thread tension adjusting device "B" includes a secondary thread press member 11, a thread press member 12, an elastic member 13, a press member 14, an adjusting wheel 15, a washer 16, a retaining member 17 and a fixing member 18 in turn mounted on the wheel shaft 100.

The secondary thread press member 11 has a center formed with a central hole 110 for passage of the wheel shaft 100 and has a periphery formed with a limit recess 111 to receive the limit shaft 101, so that the secondary thread press member 11 is fixed on the wheel shaft 100 without rotation.

The thread press member 12 has a first end having a center formed with a central hole 120 for passage of the wheel shaft 100 and having a periphery formed with a limit slot 121 to receive the limit shaft 101, so that the thread press member 12 is fixed on the wheel shaft 100 without rotation.

The press member 14 has a center formed with a screw bore 140 screwed on an outer thread 102 of the wheel shaft 100 and has a periphery formed with a plurality of limit recesses 141.

The adjusting wheel 15 has a center formed with a central hole 150 for passage of the wheel shaft 100 and has a periphery formed with a limit shaft 101 inserted into one of the limit recesses 141 of the press member 14, so that the press member 14 is rotated with the adjusting wheel 15. Thus, the press member 14 can be rotated and moved on the wheel shaft 100 by rotation of the adjusting wheel 15 to press the elastic member 13 which presses the thread press member 12 and the secondary thread press member 11 so as to adjust the tension of the sewing thread (not shown) clamped between the thread press member 12 and the secondary thread press member 11.

The thread press member 12 has a second end formed with a release extension portion 122 extended toward the thread tension releasing device "C" for operation of the thread tension releasing device "C". The first end of the thread press member 12 is formed with a thread clamping portion 123. In addition, the central hole 120 of the thread press member 12 has a diameter slightly greater than that of the wheel shaft 100, so that the thread press member 12 is slightly inclined relative to the wheel shaft 100.

Figure 4:
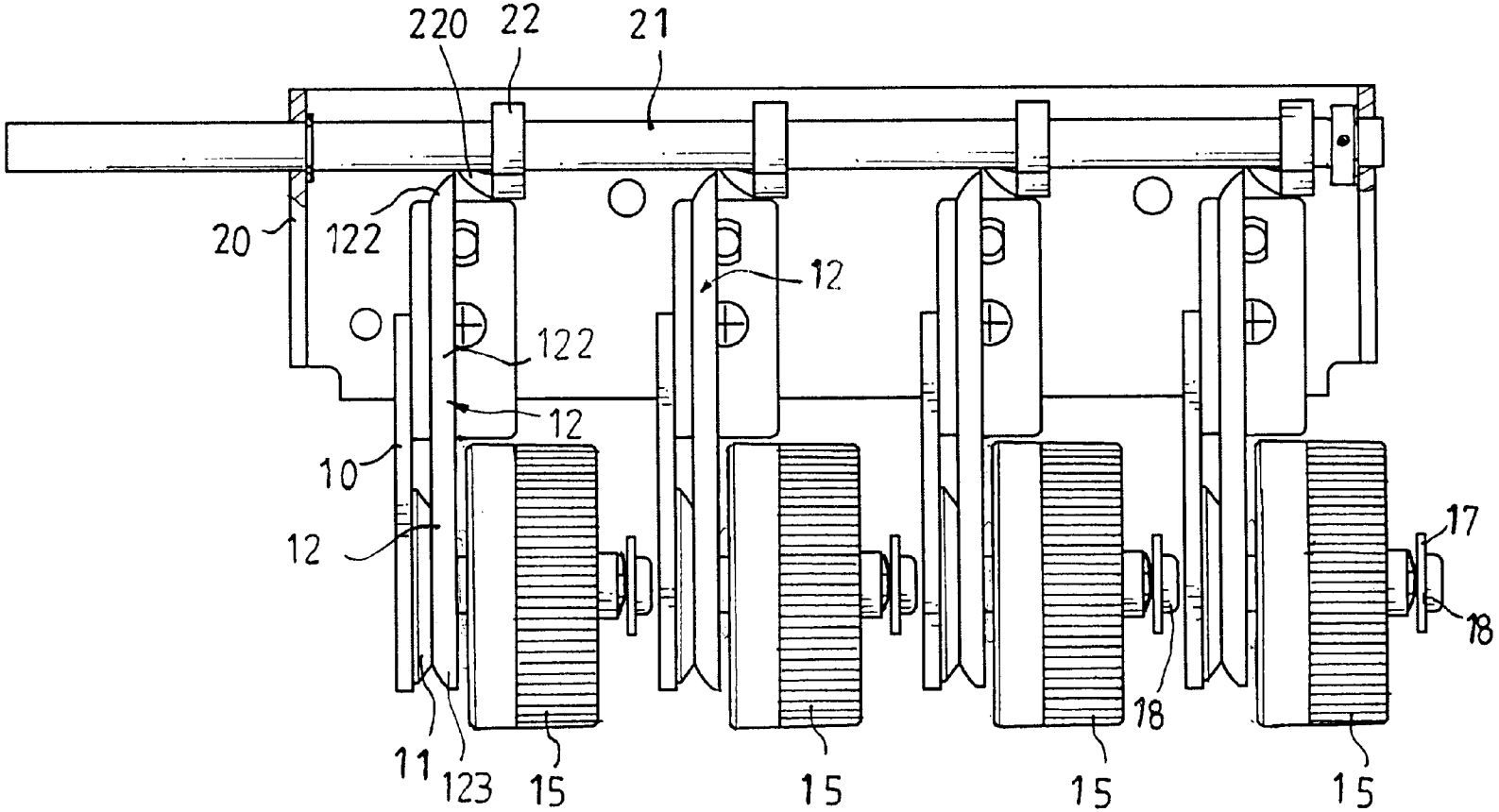
FIG. 4 is a partially cut-away top plan cross-sectional view of the sewing machine as shown in FIG. 2.
Figure 5:
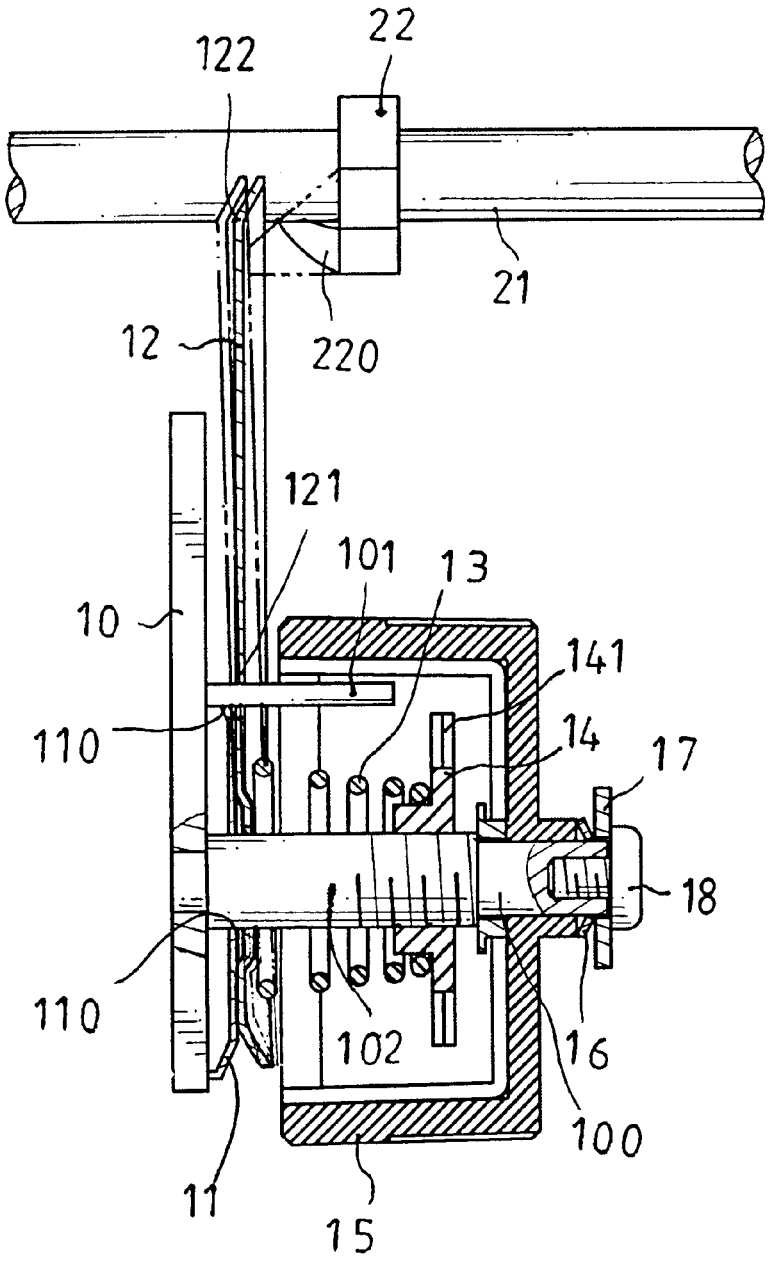
FIG. 5 is a partially cross-sectional view of the sewing machine as shown in FIG. 4.
Figure 6:
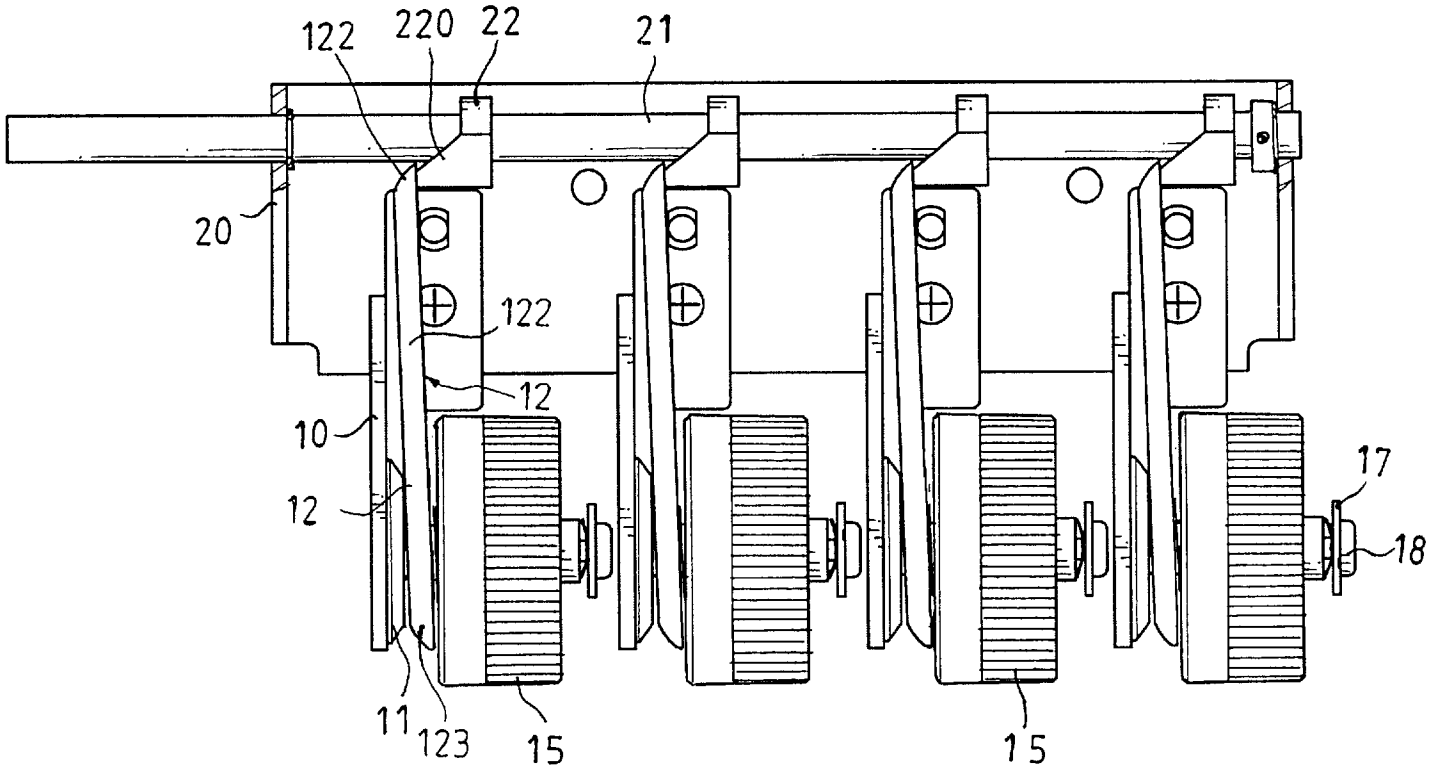
FIG. 6 is a schematic operational view of the sewing machine as shown in FIG. 4 in adjustment.

As shown in FIGS. 4–6, when the thread tension releasing device "C" does not press the release extension portion 122 of the thread press member 12, the thread press member 12 is pressed by the elastic member 13, so that the thread clamping portion 123 of the thread press member 12 is closely urged on the secondary thread press member 11 as shown in FIGS. 4 and 5, and the sewing thread is clamped between the thread press member 12 and the secondary thread press member 11 rigidly and stably. Thus, the sewing thread clamped between the thread press member 12 and the secondary thread press member 11 has a determined tension.

On the contrary, when the thread tension releasing device "C" presses the release extension portion 122 of the second end of the thread press member 12, the thread press member 12 is pivoted on the wheel shaft 100, so that the thread clamping portion 123 of the first end of the thread press member 12 is moved outward to detach from the secondary thread press member 11 as shown in FIGS. 5 and 6, thereby forming an opening (or gap) between the thread clamping portion 123 of the thread press member 12 and the secondary thread press member 11 so as to release the sewing thread clamped between the thread press member 12 and the secondary thread press member 11. Thus, the tension applied on the sewing thread is released, thereby facilitating the thread drawing and cutting procedures after the sewing work is accomplished.

Figure 2:
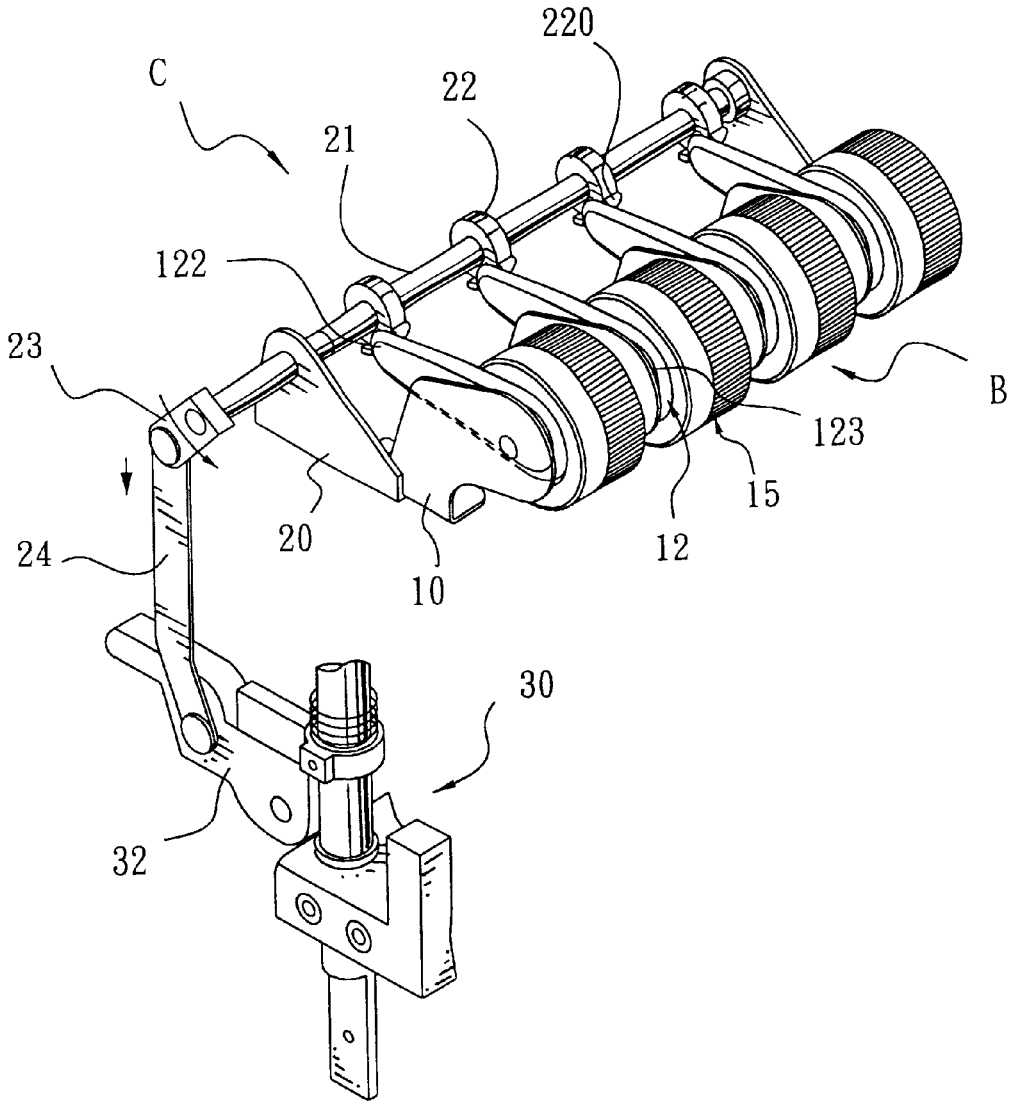
FIG. 2 is a partially perspective view of the sewing machine in accordance with the preferred embodiment of the present invention.
Figure 3:
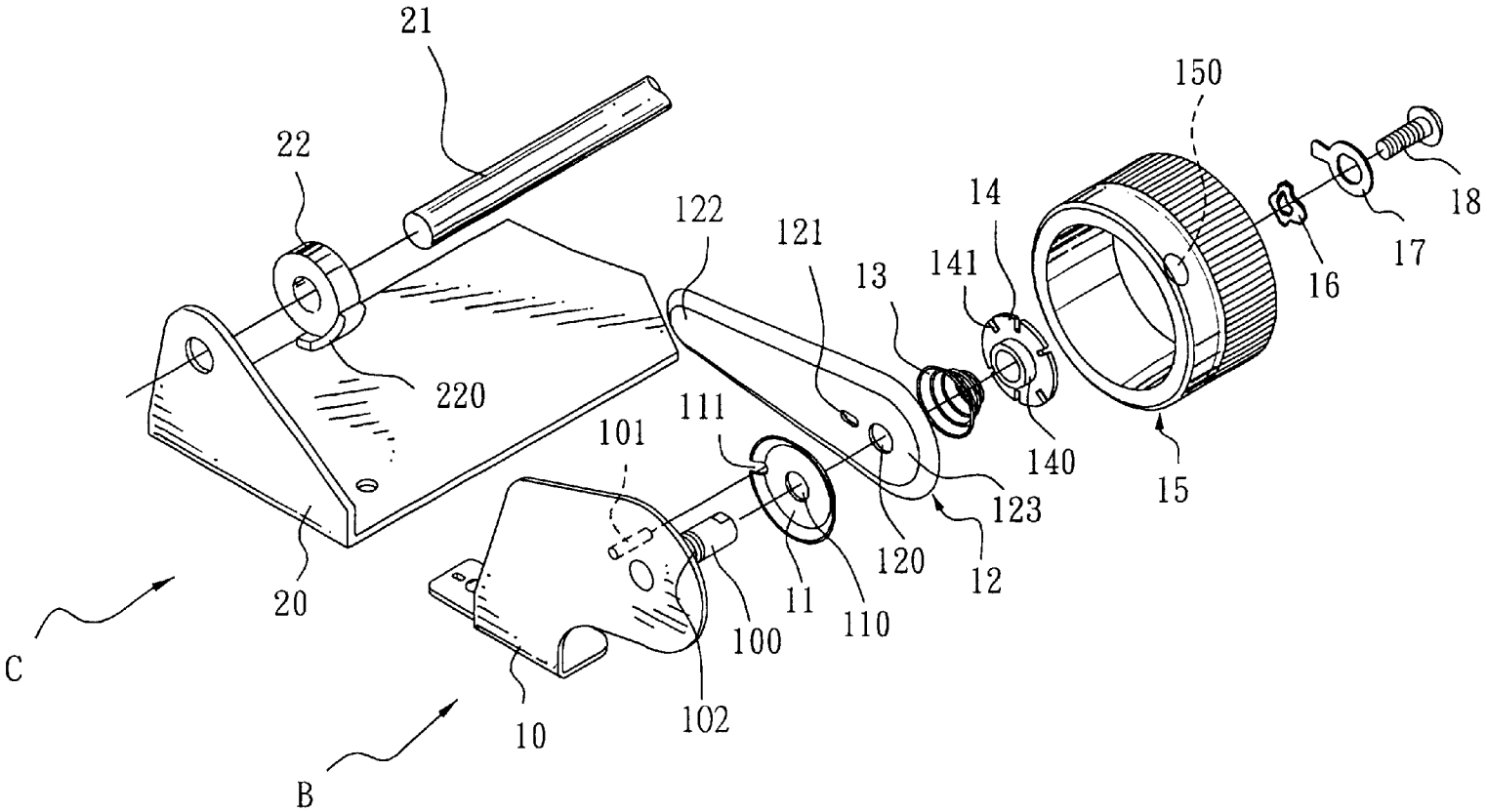
FIG. 3 is a partially exploded perspective view of the sewing machine in accordance with the preferred embodiment of the present invention.

As shown in FIGS. 2 and 3, the thread tension releasing device "C" includes a tension release bracket 20 mounted on the support seat 10 of the thread tension adjusting device "B", a rod-shaped driving member 21 mounted on the tension release bracket 20, and a plurality of release members 22 each mounted on the driving member 21 to rotate therewith. Each of the release members 22 has a periphery provided with a release portion 220 rested on the release extension portion 122 of the respective thread press member 12. The release portion 220 of each of the release members 22 has a curved configuration with different heights and angles. In such a manner, when the driving member 21 is rotated, each of the release members 22 is also rotated to move the respective release portion 220 which produces different heights and angles. Thus, the release portion 220 of each of the release members 22 can be moved to press the release extension portion 122 of the respective thread press member 12 in different heights and angles, so as to release the sewing thread clamped between the thread press member 12 and the secondary thread press member 11.

The, thread tension releasing device "C" further includes a rotation member 23 having a first end secured on an end of the driving member 21, and a linking member 24 having a first end pivotally mounted on a second end of the rotation member 23 and a second end pivotally mounted on an end portion 32 of a lift control member 30. In such a manner, when the lift control member 30 is operated, the linking member 24 is moved by the lift control member 30 to rotate the rotation member 23 which rotates the driving member 21 which rotates the release members 22 so as to rotate and move the respective release portion 220. Thus, the release portion 220 of each of the release members 22 can be moved to press the release extension portion 122 of the respective thread press member 12 so as to release the sewing thread clamped between the thread press member 12 and the secondary thread press member 11.

Accordingly, the sewing machine in accordance with the preferred embodiment of the present invention has the following advantages.

1. The thread tension releasing device "C" directly presses the release extension portion 122 of the thread press member 12 of the thread tension adjusting device "B", so as to release the tension of the sewing thread, so that the tension of the sewing thread can be released easily and rapidly.

2. The tension of the sewing thread is released by operating the lift control member 30 directly, so that the tension of the sewing thread can be released exactly and rapidly, thereby simplifying the tension release operation.

3. The thread press member 12 is integrally formed with the release extension portion 122 without having to additionally provide other element, thereby simplifying the construction, and thereby saving costs of fabrication.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A sewing machine, comprising:

a thread tension adjusting device including a thread press member having a first end and a second end, the second end of the thread press member being formed with a release extension portion, the thread tension adjusting device including:

(a) a support seat for supporting the thread press member;

(b) a secondary thread press member mounted on the support seat; and (c) an elastic member mounted on the support seat to press the thread press member on the secondary thread press member; the support seat having an end portion provided with a wheel shaft and a limit shaft, and the secondary thread press member, the thread press member and the elastic member being mounted on the wheel shaft of the support seat; and, a thread tension releasing device rested and pressed on the release extension portion of the second end of the thread press member of the thread tension adjusting device to pivot the thread press member so as to move the first end of the thread press member.

2. The sewing machine in accordance with claim 1, wherein the secondary thread press member has a center formed with a central hole for passage of the wheel shaft and has a periphery formed with a limit recess to receive the limit shaft, so that the secondary thread press member is fixed on the wheel shaft without rotation.

3. The sewing machine in accordance with claim 1, wherein the thread press member has a first end having a center formed with a central hole for passage of the wheel shaft and having a periphery formed with a limit slot to receive the limit shaft, so that the thread press member is fixed on the wheel shaft without rotation.

4. The sewing machine in accordance with claim 3, wherein the central hole of the thread press member has a diameter greater than that of the wheel shaft, so that the thread press member is inclined relative to the wheel shaft.

5. The sewing machine in accordance with claim 1, wherein the thread tension adjusting device further includes:

a press member having a center formed with a screw bore screwed on an outer thread of the wheel shaft and a periphery formed with a plurality of limit recesses; and an adjusting wheel having a center formed with a central hole for passage of the wheel shaft and having a periphery formed with a limit shaft inserted into one of the limit recesses of the press member, so that the press member is rotated with the adjusting wheel.

6. The sewing machine in accordance with claim 5, wherein the press member is rotated and moved on the wheel shaft by rotation of the adjusting wheel to compress the elastic member to press the thread press member and the secondary thread press member.

7. A sewing machine, comprising:

a thread tension adjusting device including a thread press member having a first end and a second end, the second end of the thread press member being formed with a release extension portion; and a thread tension releasing device rested and pressed on the release extension portion of the second end of the thread press member of the thread tension adjusting device to pivot the thread press member so as to move the first end of the thread press member, the thread tension releasing device including a tension release bracket, driving member mounted on the tension release bracket, and a plurality of release members each mounted on the driving member to rotate therewith and each provided with a release portion rested on the release extension portion of the respective thread press member.

8. The sewing machine in accordance with claim 7, wherein the release portion of each of the release members has a curved configuration.

9. The sewing machine in accordance with claim 7, wherein the thread tension releasing device further includes a rotation member having a first end secured on an end of the driving member, and a linking member having a first end pivotally mounted on a second end of the rotation member and a second end pivotally mounted on an end portion of a lift control member.

10. The sewing machine in accordance with claim 3, wherein when the thread tension releasing device presses the release extension portion of the second end of the thread press member, the thread press member is pivoted on the wheel shaft, so that a thread clamping portion of the first end of the thread press member is moved outward to detach from the secondary thread press member, thereby forming an opening between the thread clamping portion of the thread press member and the secondary thread press member.

* * * * *